US008154315B2

(12) United States Patent
Henson et al.

(10) Patent No.: US 8,154,315 B2
(45) Date of Patent: Apr. 10, 2012

(54) SELF-REFERENCING VOLTAGE REGULATOR

(75) Inventors: Roy John Henson, Pleasanton, CA (US); Harry Joe Tabor, Portland, OR (US)

(73) Assignee: FormFactor, Inc., Livermore, CA (US)

( * ) Notice: Subject to any disclaimer, the term of this patent is extended or adjusted under 35 U.S.C. 154(b) by 703 days.

(21) Appl. No.: 12/168,045

(22) Filed: Jul. 3, 2008

(65) Prior Publication Data

US 2009/0251123 A1 Oct. 8, 2009

Related U.S. Application Data

(60) Provisional application No. 61/043,313, filed on Apr. 8, 2008.

(51) Int. Cl.
*G05F 1/40* (2006.01)
*G01R 31/02* (2006.01)

(52) U.S. Cl. ..... 324/754.01; 323/285

(58) Field of Classification Search ..... 323/268, 323/271, 280, 281, 282, 285; 324/538, 754.01, 324/756.01
See application file for complete search history.

(56) References Cited

U.S. PATENT DOCUMENTS

| | | | | |
|---|---|---|---|---|
| 6,339,338 | B1 | 1/2002 | Eldridge et al. | |
| 6,456,103 | B1 | 9/2002 | Eldridge et al. | |
| 6,545,603 | B1 * | 4/2003 | Launay et al. | 340/540 |
| 6,657,455 | B2 | 12/2003 | Eldridge et al. | |
| 6,949,942 | B2 | 9/2005 | Eldridge et al. | |
| 7,187,194 | B2 | 3/2007 | Robertazzi | |
| 7,245,120 | B2 | 7/2007 | Eldridge et al. | |
| 7,262,624 | B2 | 8/2007 | Miller | |
| 7,342,405 | B2 | 3/2008 | Eldridge et al. | |
| 7,541,786 | B2 * | 6/2009 | Yen | 323/280 |
| 7,746,061 | B2 * | 6/2010 | Chang et al. | 324/750.2 |
| 2006/0217906 | A1 | 9/2006 | Barbara et al. | |
| 2007/0257696 | A1 | 11/2007 | Eldridge et al. | |
| 2007/0290676 | A1 | 12/2007 | Miller | |

OTHER PUBLICATIONS

U.S. Appl. No. 60/594,248, filed Mar. 22, 2005 entitled "Voltage Fault Detection and Protection Description", 17 pages.

* cited by examiner

*Primary Examiner* — Matthew Nguyen
(74) *Attorney, Agent, or Firm* — Kirton & McConkic

(57) ABSTRACT

A voltage regulator includes an input terminal for receiving a power input having a first voltage level, and an output terminal for generating a power output. A reference signal having a second voltage level is derived from the first voltage level adjusted with a predetermined offset value for controlling the power output to be at a third voltage level proportional to the second voltage level.

20 Claims, 8 Drawing Sheets

SELF-REFERENCING VOLTAGE REGULATOR

BACKGROUND

A voltage regulator is an electronic device that compares an input voltage with a reference voltage to generate an output at a selected voltage level. Voltage regulators can be used in many circuit applications that require a constant level of power supply. One of such applications can be a probe card assembly interfacing between at least one tester and one or more devices under test (DUTs), which may be, for example, one or more dies of a semiconductor wafer, one or more singulated semiconductor dies of an array of dies, or any other electronic device or devices. The probe card assembly can include a plurality of probes with electrical and mechanical characteristics capable of forming resilient pressure contacts with a plurality of terminals of DUTs to send and/or receive signals to/from the DUTs. The probe card assembly can also include a number of connectors adapted to be connected to a tester via one or more communication links. The probe card assembly can be embedded with wirings connecting the connectors on one side and the probes on the other side. Thus, when the tester is connected to the probe card assembly and the probes are brought in contact with the terminals of DUTs, the tester can transmit testing signals to the DUTs and receive resulting signals therefrom. The tester can analyze the received resulting signals to determine whether any of the DUTs is defective.

FIG. 1A illustrates a system 100 in which a probe card assembly 106 is connected to a tester 102 via a communication link 108. The probe card assembly 106 can include a number of voltage regulators VR1, . . . and VRn connected to a number of DUTs (DUT1, . . . and DUTn, where n can range from 1 to a number greater than 1) via a number of test channels CH1, . . . and CHn, respectively. Each of the test channels CH1, . . . and CHn can include, among other things, a probe in contact with a terminal of each DUT (physical structures of the probes and the terminals are not shown in this figure). The voltage regulators VR1, . . . and VRn can receive power inputs from a power supply (not shown) in the tester 102, and generate power outputs at a selected voltage level to their corresponding DUTs (DUT1, . . . and DUTn). The voltage regulators VR1, . . . and VRn are often current limited, so that a defective DUT that draws a large amount of current would not significantly affect the current supply for other functional DUTs. Oftentimes, the tester is required to program the voltage regulators to output a selected voltage. This programming can require a number of control channels.

FIG. 1B schematically illustrates a conventional voltage regulator 110 adapted to be used as the voltage regulators VR1, . . . and VRn employed in the system 100 shown in FIG. 1A. The voltage regulator 110 can include a variable switch 112 and a controller 114. The variable switch 112 can receive a power input Vin from a power supply, and generate a power output Vout at a selected voltage level. The controller 114 can receive a sense signal Vsense indicating a voltage level of the power output Vout, and compare it with a reference voltage Vref to generate a control signal based on the voltage difference between the sense signal Vsense and the reference voltage Vref. The greater the difference between the sense signal Vsense and the reference voltage Vref, the more or less the variable switch 112 is turned on. When the variable switch 112 and the controller 114 are in equilibrium, the voltage level of the sense signal Vsense (hence, the voltage level of the power output Vout) would become equal a value proportional to the reference voltage Vref, thereby controlling the power output Vout of the variable switch 112 at a selected, predetermined level.

Conventionally, the voltage level of the reference voltage Vref is not sensitive to that of the power input Vin. The reference voltage Vref is adjusted independently from the power input Vin in order to alter the power output Vout. In the context where the voltage regulator 110 is employed in an apparatus such as the test system 100 shown in FIG. 1A, the reference voltages of voltage regulators VR1, . . . and VRn need to be programmed individually and independently by digital or analog methods in order to ensure all the power outputs from the voltage regulators VR1, . . . and VRn to be at a predetermined voltage level. If the predetermined voltage level were to be changed, all of the voltage regulators VR1, . . . and VRn would need to be reprogrammed individually and independently. Such reprogramming requires complex circuit designs to implement a digital or analog control scheme over the voltage regulators. In case where those voltage regulators are implemented in a probe card assembly, the complex circuit design requirements can increase the costs of designing and fabricating the probe card assembly significantly. Such reprogramming can also be time-consuming and prone to errors. As a result, such reprogramming can prolong the time required to ready the probe card assembly to perform tests, thereby increasing the tested per unit time of each DUT.

SUMMARY

The invention can be related to a voltage regulator. In some embodiments of the invention, the voltage regulator can include an input terminal for receiving a power input having a first voltage level, and an output terminal for generating a power output. A reference signal having a second voltage level is derived from the first voltage level adjusted with a predetermined offset value for controlling the power output to be at a third voltage level proportional to the second voltage level.

The invention can be related to a method for adjusting a power output of a voltage regulator. In some embodiments of the invention, the power output can be generated in response to a power input at a first voltage level and a reference signal at a second voltage level can be derived from the first voltage level adjusted with a predetermined offset value. The first voltage level of the power input can be adjusted to change the second voltage level of the reference signal, wherein a third voltage level at which the power output is generated follows the second voltage level.

The invention can be related to a probe card assembly for testing electronic devices. In some embodiments of the invention, the probe card assembly for testing an electronic device can include a substrate having a plurality of probes extending therefrom for forming electrical contacts with the electronic device. One or more electrical pathways adapted to electrically connect the probes to a tester can be provided. A voltage regulator can be coupled to the electrical pathways, and have an input terminal for receiving a power input having a first voltage level, and an output terminal for generating a power output. A reference signal having a second voltage level derived from the first voltage level adjusted with a predetermined offset value can be used to control the power output to be at a third voltage level proportional to the second voltage level.

The invention can be related to a method for testing an electronic device. In some embodiments of the invention, one or more electrical contacts can be formed between a probe card assembly and the electronic device. A voltage regulator of the probe card assembly can be supplied with a power input. A power output of the voltage regulator can be adjusted by generating the power output in response to a power input at a first voltage level and a reference signal at a second voltage level derived from the first voltage level adjusted with a predetermined offset value. The first voltage level of the power input can be adjusted to change the second voltage level of the reference signal, wherein a third voltage level at which the power output is generated follows the second voltage level.

BRIEF DESCRIPTION OF THE DRAWINGS

Where possible, identical reference numbers are used herein to designate elements that are common to the figures. The images used in the drawings may be simplified for illustrative purposes and are not necessarily depicted to scale.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein. Moreover, the figures can show simplified or partial views, and the dimensions of elements in the figures can be exaggerated or otherwise not in proportion for clarity. In addition, as the terms "on" and "attached to" are used herein, one object (e.g., a material, a layer, a substrate, etc.) can be "on" or "attached to" another object regardless of whether the one object is directly on or attached to the other object or there are one or more intervening objects between the one object and the other object. Also, directions (e.g., above, below, top, bottom, side, up, down, over, under, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

Embodiments of the invention are directed to voltage regulators with a reference signal having a voltage level depending on that of a power input thereof, such that a power output of the voltage regulators can be adjusted by altering the voltage level of the power input. A larger number of voltage regulators can be configured to receive the power inputs from a smaller number of power supplies. Thus, the power outputs of the larger number of the voltage regulators can be adjusted by altering the power inputs from the smaller number of power supplies. As a result, the need of programming and/or reprogramming the voltage regulators individually and independently in order to alter the power outputs can be eliminated. Such voltage regulators can be advantageous in systems that require frequent adjustment of a plurality of voltage regulators. For example, in a test system implemented with a probe card assembly having a plurality of the proposed voltage regulators, the power outputs thereof can be adjusted in a much simpler manner than conventional voltage regulators. Other advantages resulted from systems employing the proposed voltage regulators will be discussed in greater detail in following paragraphs.

Figure 2:
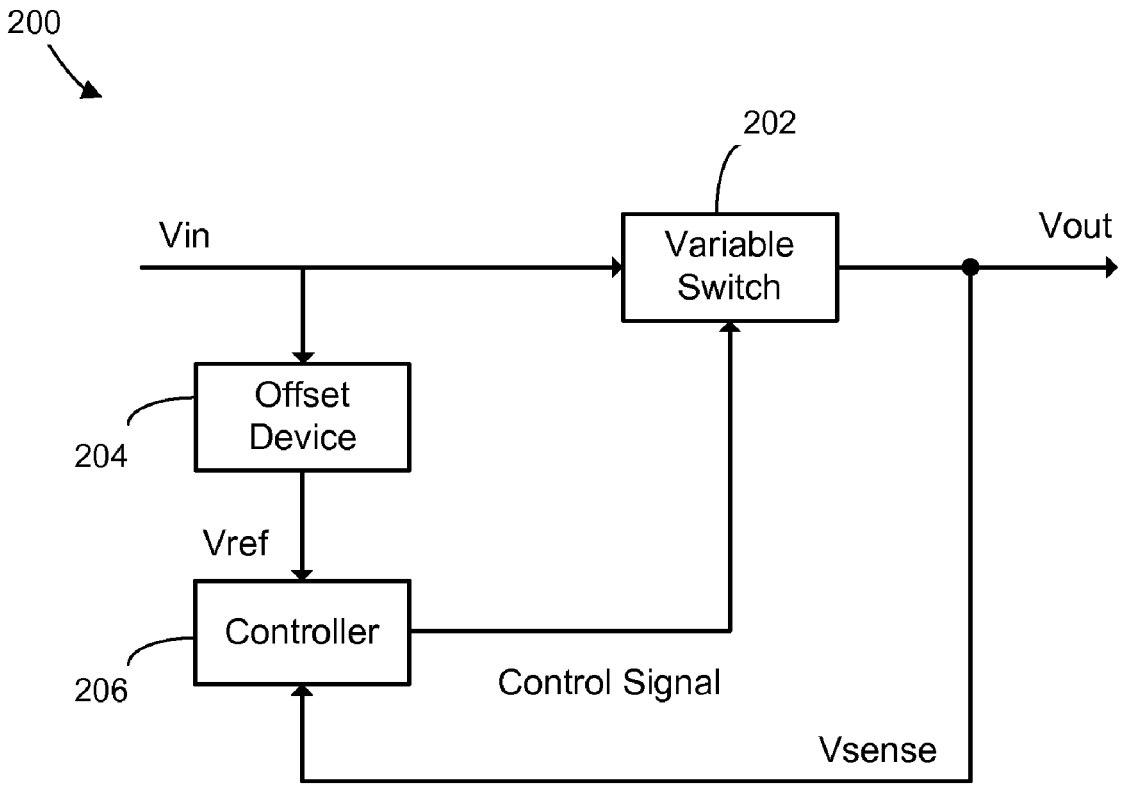
FIG. 2 illustrates a block diagram showing a voltage regulator in accordance with some embodiments of the invention.

FIG. 2 illustrates a block diagram showing a voltage regulator 200 in accordance with some embodiments of the invention. The voltage regulator 200 can include, among other things, a variable switch 202, an offset device 204, and a controller 206. The variable switch 202 and the controller 206 can be collectively referred to as a tuning circuit. The variable switch 202 can have a first input terminal coupled to a power input Vin from an apparatus such as a power supply, a second input terminal coupled an output terminal of the controller 206, and an output terminal that generates a power output Vout. The controller 206 can have a first input terminal adapted to receive a sense signal Vsense indicating a voltage level of the power output Vout, and a second input terminal coupled to an output terminal of the offset device 204, which can have an input terminal adapted to receive the power input Vin. In some embodiments of the invention, the sense signal Vsense can be sampled at a point between the variable switch 202 and a terminal of DUT with which a probe of a probed card is positioned to form a resilient pressure contact.

The variable switch 202 can generate the power output Vout at a voltage level different from that of the power input Vin, depending on the extent to which it is turned on by a control signal generated by the controller 206. The controller 206 can receive the sense signal Vsense indicating a voltage level of the power output Vout. For example, the sense signal Vsense can have a voltage level the same as or proportional to the voltage level of the power output Vout. The controller 206 can compare it with a reference signal Vref generated by the offset device 204. The reference signal Vref can have components such as voltage, current, wave shape, and frequency. The voltage level of the reference signal Vref can be determined by subtracting a predetermined offset value from the voltage level of the power input Vin received by the offset device 204. The greater the voltage difference between the sense signal Vsense and the reference signal Vref, the more or less the variable switch 202 is turned on. When the variable switch 202 and the controller 206 are in equilibrium, the voltage level of the power output Vout would become equal a value proportional to that of the reference signal Vref, thereby controlling the power output Vout of the variable switch 202 at a predetermined level, for example Vin minus the predetermined offset value.

The predetermined offset value can be a constant. Thus, the voltage level of the reference signal Vref can depend on the voltage level of power input Vin by a known offset value. As a result, the voltage level of the power output Vout from the variable switch 202 can be adjusted by altering the voltage level of the power input Vin. Since the voltage level of the power input Vin can be provided by a power supply external to the voltage regulator 200, the voltage level of the power output Vout can be adjusted by controlling the power supply without internal programming and/or reprogramming. In some embodiments of the invention, this can remove the need for complex conventional controlling schemes by using only the Vin to control the Vout, taking into consideration of the predetermined offset value.

Figure 3:
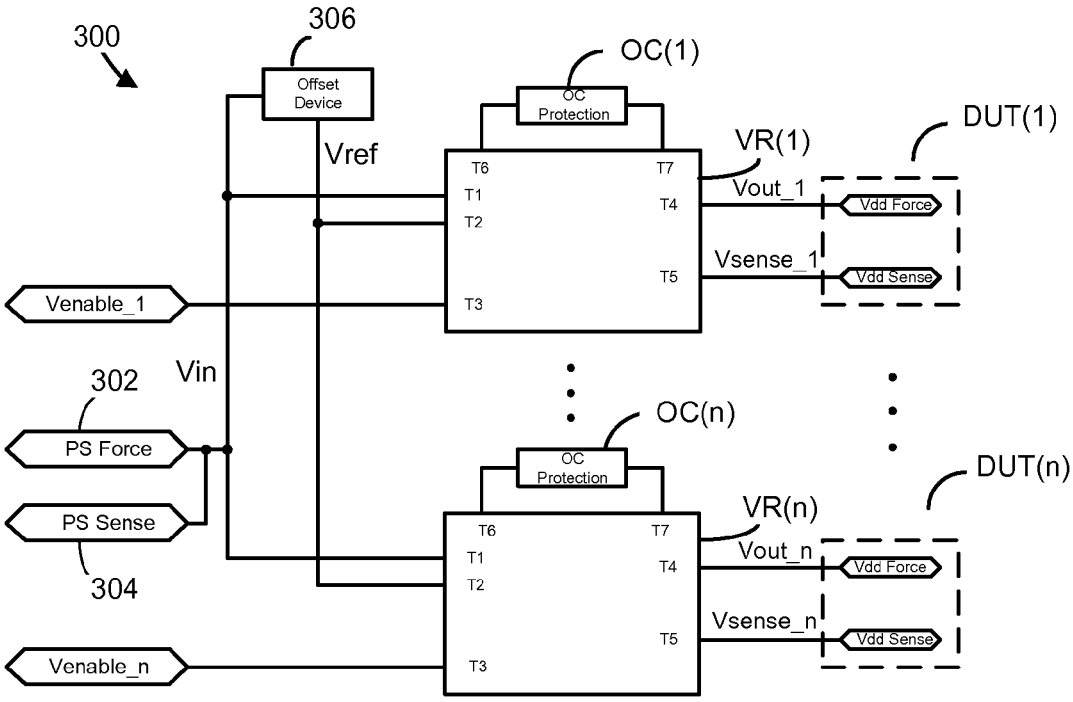
FIG. 3 illustrates a block diagram showing a voltage regulator array in accordance with some embodiments of the invention.

FIG. 3 illustrates a block diagram showing a voltage regulator array 300 in accordance with some embodiments of the invention. The voltage regulator array 300 can be implemented in many applications, such as a probe card assembly used in conjunction with a prober and a tester for testing a plurality of DUTs. Although the voltage regulator array 300 is described and explained in the context of probe card assemblies in this disclosure, the voltage regulator array 300 can also be used in apparatuses or systems other than probe card assemblies without deviating from the spirit of the invention.

The voltage regulator array 300 can include a number of voltage regulators VR(1), . . . and VR(n), where n can range from 1 to a number greater than 1, coupled between one or more power supplies (not shown in the figure) and their corresponding DUTs (DUT(1), . . . DUT(n)). Each of the voltage regulators VR(1), . . . and VR(n) can include a plurality of terminals T1, T2 . . . T7. Terminal T1 can be coupled to the one or more power supplies at pads, such as 302 and 304. Terminal T2 can be coupled to an offset device 306, which can be further coupled to the one or more power supplies (not shown) at pads, such as 302 and 304. The one or more power supplies can be implemented in an electronic apparatus, such as a tester connected to a probe card assembly, examples of which will be described in greater details in following paragraphs with reference to FIGS. 7 and 8. In some embodiments of the invention, terminal T3 can be coupled to an enable signal Venable_1, . . . or Venable_n for enabling its corresponding voltage regulator VR(1), . . . or VR(n). Terminal T4 can be coupled to DUT(1), . . . or DUT(n) for providing the same with a corresponding power output Vout_1, . . . or Vout_n. Terminal T5 can be coupled to DUT(1), . . . or DUT(n) for receiving there form a corresponding sense signal Vsense_1, . . . or Vsense_n indicating a voltage level of its corresponding power output Vout_1, . . . or Vout_n. In some embodiments of the invention, T4 and T5 can be connected together close to the voltage regulator VR(i) (i can be any number from 1 to n), whereas in some embodiments, a connection can occur at any point between the VR(i) and the DUT(i), and in further embodiments, a connection can occur on the DUT(i), and in still further embodiments a connection can occur electronically through the DUT(i). In some embodiments of the invention, terminals T6 and T7 can be coupled to a corresponding over-current protection device OC(1), . . . or OC(n), which can protect the power supply from an over-current exceeding a predetermined over-current value.

Note that although only two voltage regulators VR(1) and VR(n) are depicted in this figure, the number of voltage regulators is by no means limited to two and can be more or less than two. Also note that although only one offset device 306 is depicted in the figure, the number of offset devices is by no means limited to one and can be more than one. For example, the number of offset devices can be the same as that of voltage regulators, and each offset device can be coupled to its corresponding voltage regulator. As another example, each one offset device can be coupled to a group of voltage regulators, and the number of voltage regulators each offset device is coupled to can be different. For example, one offset device can be configured to couple with three voltage regulators, whereas another offset device can be configured to couple with four voltage regulators.

Figure 1A:
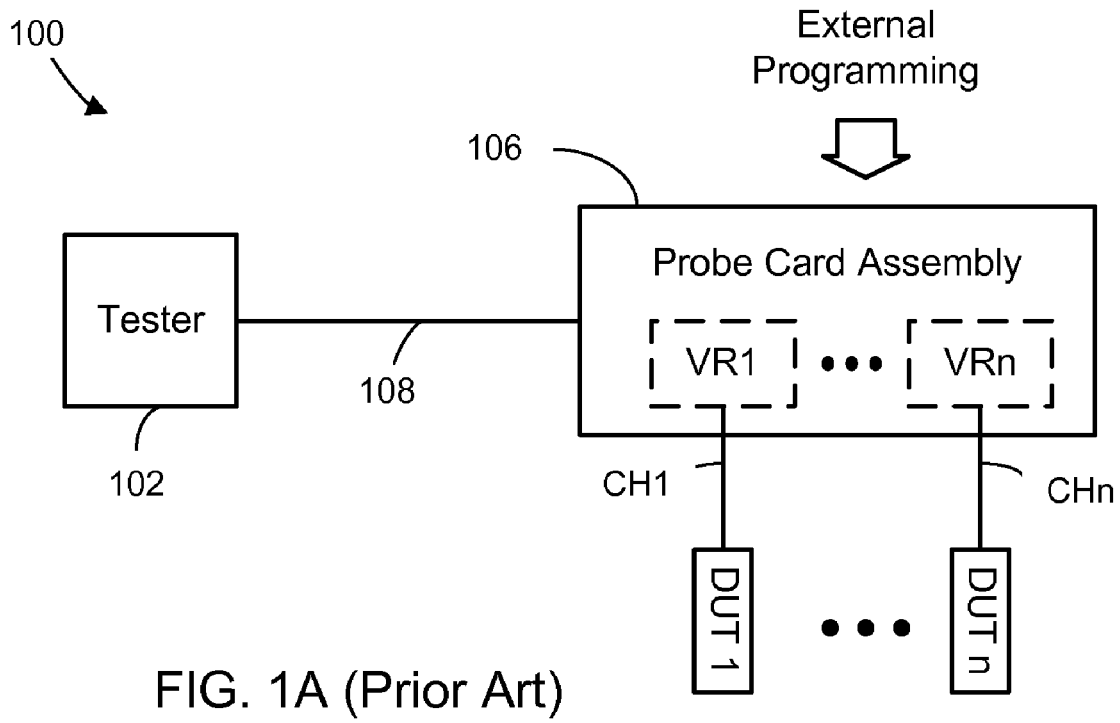
FIG. 1A (Prior Art)
FIG. 1A illustrates a block diagram showing a system where a number of voltage regulators are implemented in a probe card assembly interfacing between a tester and a plurality of DUTs.
Figure 1B:
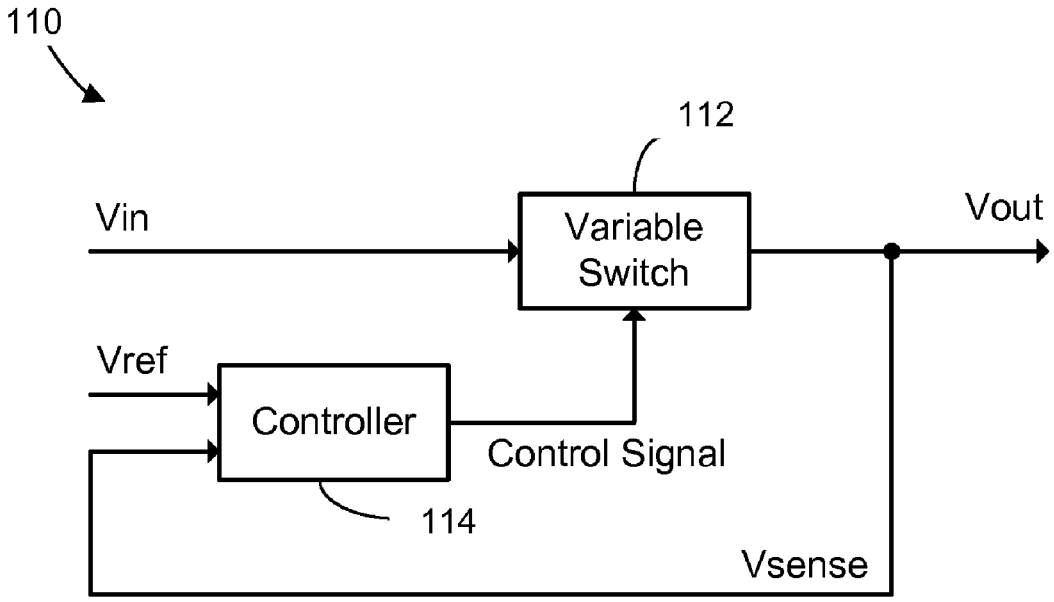
FIG. 1B (Prior Art)
FIG. 1B illustrates a block diagram showing a conventional voltage regulator that may be implemented in the system shown in FIG. 1A.

During operation of some embodiments, one or more of the voltage regulators VR(1), . . . and VR(n) can be selectively enabled or disabled by asserting one or more of the enable signals Venable_1, . . . and Venable_n. The enabled voltage regulator VR(1), . . . or VR(n) can receive a power input Vin at terminal T1 and a reference signal Vref at terminal T2, whose voltage level can be determined by subtracting the voltage level of the power input Vin with a predetermine offset value. The enabled voltage regulator VR(1), . . . or VR(n) can generate the power output Vout_1, . . . or Vout_n, and receive a sense signal Vsense_1, . . . or Vsense_n indicating a voltage level of its corresponding power output Vout_1, . . . or Vout_n. The enabled voltage regulator VR(1), . . . or VR(n) can compare the reference signal Vref with the received sense signal Vsense_1, . . . or Vsense_n to adjust the voltage level of the power output Vout_1, . . . or Vout_n until the voltage level of the power output Vout_1, . . . or Vout_n becomes equal a value proportional to the reference signal Vref Given a constant offset value, adjusting the voltage level of the power input Vin can change the voltage level of the reference signal Vref, and therefore the voltage level of the power outputs Vout_1, . . . and Vout_n. In the context where the voltage regulator array 300 is implemented in a probe card assembly coupled to a tester for testing DUTs (such as a system generally described in FIG. 1A), the power outputs Vout_1, . . . and Vout_n for their corresponding DUTs (DUT (1), . . . and DUT(n)) can be adjusted simply by altering the voltage level of the power input Vin generated by a power supply in the tester. This can eliminate the need of programming and reprogramming the voltage regulators independently and individually in order to provide the DUTs with power outputs at a desired voltage level. The proposed voltage regulators, for example as the ones illustrated in FIG. 3, can simplify the design and operation of probe card assemblies, and shorten the time required to ready the probe card assemblies for testing. As a result, the costs of making the probe card assemblies can be reduced, and the tested per unit time of each DUT can be reduced.

Note that the voltage regulator VR(1), . . . VR(n) can be understood as being able to carry out, among other things, the functions of the controller 206 and the variable switch 202 shown in FIG. 2 in the sense that the controller 206 can generate a control signal based on a voltage difference between the reference signal Vref and the sense signal Vsense to control the variable switch 202. In some embodiments of the invention, the offset device 306 can be implemented internally in each voltage regulator VR(1), . . . or VR(n) as shown in FIG. 2, instead of a separate element as shown in FIG. 3.

Note that the enable signals Venable_1, . . . and Venable_n can be optional. In some embodiments of the invention, the enable signals Venable_1, . . . and Venable_n can be omitted. In some embodiments of the invention, one enable signal can control more than one voltage regulators VR(1), . . . and VR(n), simultaneously. Note that the numbers of voltage regulators controlled by different enable signals can be different. For example, one enable signal can be configured to control two voltage regulators simultaneously, whereas another enable signal can be configured to control three voltage regulators simultaneously.

In some embodiments, during an over-current event where the current of the power input Vin exceeds a predetermined over-current value, the over-current protection devices OC(1), . . . and OC(2) can prevent the voltage regulators VR(1), . . . and VR(n) from passing through the over-current that may damage the DUTs (DUT(1), . . . and DUT(n)). In some embodiments of the invention, the over-current protection device OC(1), . . . and OC(n) can be current clamp devices that limit the current passing through the voltage regulators VR(1), . . . and VR(n) in a predetermined allowable range. In some embodiments of the invention, the over-current protection devices OC(1), . . . and OC(n) can be current trip devices that prevent an current from passing through the voltage regulators VR(1), . . . and VR(n), when the current exceeds a predetermined over-current value. One or more reset devices can be used to reset the current trip devices. For example, each of the current trip devices can be independently coupled with a corresponding reset device for each voltage regulator VR(1), VR(2) . . . VR(n). As another example, a master reset device can be used to reset all the current trip devices simultaneously. In some embodiments of the invention, the reset device(s) can utilize a power-on-reset scheme that generates a reset signal when it is supplied with power.

The over-current protection devices can be implemented in various manners. For example, the over-current protection devices can be implemented by electronic devices, such as PMOS devices, NMOS devices, PNP bipolar devices, NPN bipolar devices, logic gates, resistors, and a combination thereof. The over-current devices can be fabricated in a form of conventional or integrated circuit.

Note that the over-current protection devices OC(1), . . . and OC(n) can be optional. In some embodiments of the invention, one over-protection device can be configured to control two or more voltage regulators. Note that the numbers of voltage regulators controlled by different over-current protection devices can be different. For example, one over-current protection device can be configured to control two voltage regulators simultaneously, whereas another over-current protection device can be configured to control three voltage regulators simultaneously.

Figure 4:
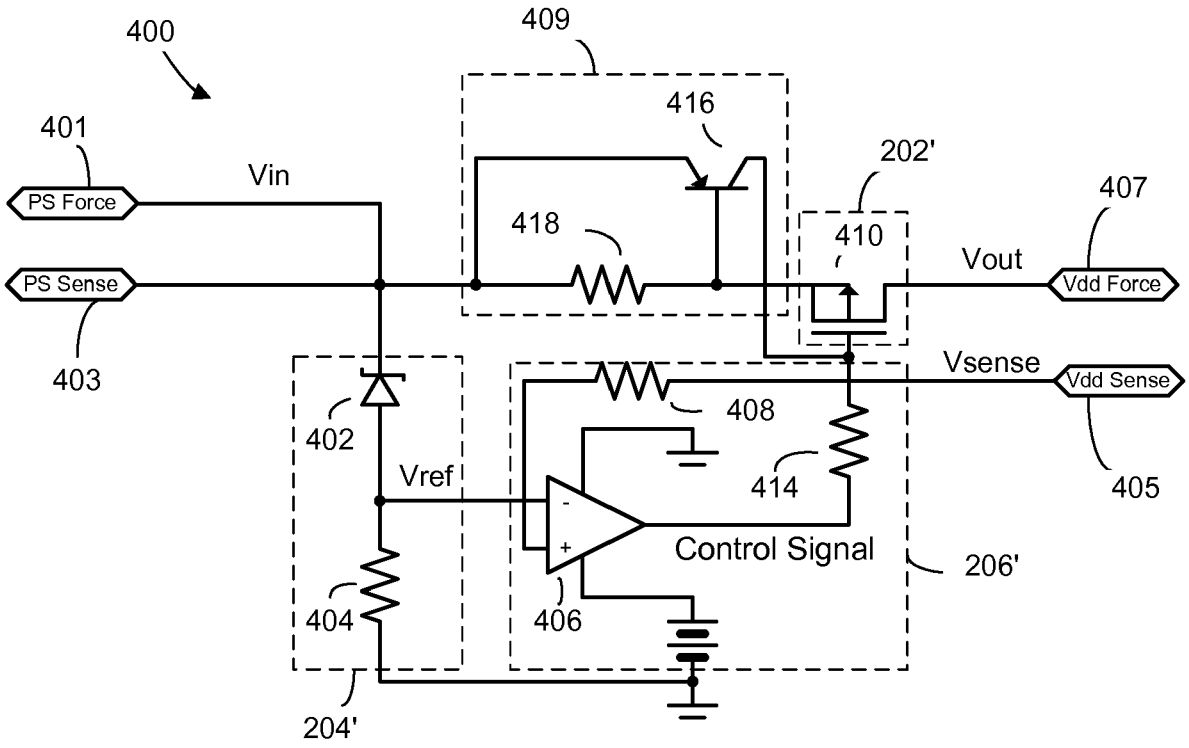
FIG. 4 schematically illustrates a proposed voltage regulator in accordance with some embodiments of the invention.

FIG. 4 schematically illustrates a proposed voltage regulator 400 in accordance with some embodiments of the invention. The voltage regulator 400 can include a variable switch 202', a controller 206', and an offset device 204' configured in a manner similar to those in FIG. 2. The voltage regulator 400 can include an optional over-current protection device 409 for protecting a power supply against an over-current exceeding a predetermined value. Although only one possible circuit implementation is illustrated for each of 202', 204', 206' and 409, others sufficient to function as described herein are equally contemplated. The schematic implementation illustrated in FIG. 4 is merely an example of one possible embodiment of the invention.

The voltage regulator 400 can include, for example, a Zener Schottky diode 402 reversely coupled between pads 401, 403 and a resistor 404. An operational amplifier 406 can have a first input node coupled between the Zener Schottky diode 402 and the resistors 404, a second input node coupled to a resistor 408, and an output node coupled a resistor 414. The resistor 408 can be further coupled to a sense line at a pad 405 that senses a voltage level on a force line connected to one or more electronic devices, such as DUTs. The resistor 414 can be further coupled to the gate of a PMOS device 410, which can have a source coupled to a resistor 418, and a drain coupled to the force line connected to the DUTs at a pad 407. A PNP bipolar device 416 can have an emitter coupled between the resistor 418 and the pad 401 and/or 403, a collector coupled to the gate of the PMOS device 410, and a base coupled between the resistor 418 and the source of the PMOS device 410.

In operation, the Zener Schottky diode 402 coupled with the resistor 404 can function as the offset device 204 shown in FIG. 2 to subtract a predetermined offset value from the voltage level of the power input Vin at pads 401 and 403. Since the Zener Schottky diode 402 is reversely biased and coupled to ground through a resistor 404, it can allow a current to pass through with a voltage drop predetermined by characteristics thereof. As a result, the voltage level of a reference signal Vref at the first input node of the operational amplifier 406 can be substantially equal to the voltage level of the power input Vin minus the predetermined offset value.

The second input node of the operational amplifier 406 can receive from the sense line at the pad 405 a sense signal Vsense and compare the sense signal Vsense with the reference signal Vref. In some embodiments of the invention, the sense signal Vsense can be sampled at a point between the variable switch 202 and a terminal of DUT with which a probe of a probed card is positioned to form a resilient pressure contact. If the voltage level of the sense signal Vsense is greater than the voltage level of the reference signal Vref, the operational amplifier 406 can generate a control signal to control the gate of the PMOS device 410. The greater the voltage difference, the higher or lower of the voltage level the control signal has. Adjusting the control signal from the operational amplifier 406 can control a voltage drop for the power input Vin passing across the PMOS device 410, which in turn causes the voltage level of the power output Vout to drop until it becomes substantially equal a value proportional to the voltage level of the reference signal Vref. As such, the voltage level of the power output Vout at the pad 407 can be adjusted simply by changing the voltage level of the power input Vin at the pad 401.

The PNP bipolar device 416 and the resistor 418 can function as the over-current protection device OC(1), . . . or OC(n) shown in FIG. 3. In normal operation, the PNP bipolar device 416 can be turned off to a certain extent. When an over-current occurs, the voltage level at the base with respect to the emitter of the PNP bipolar device 416 would become much lower due to a large amount of current passing through the resistor 418. As a result, the PNP bipolar device 416 would be turned on, and the over-current can be passed to the gate of the PMOS device 410. In the meantime, the resistor 414 can limit the current from the operational amplifier 406, so that it is not able to control the PMOS device 410 during the over-current event. Thus, the PMOS device 410 can be turned off to an extent, thereby preventing the over-current from completely passing there through and damaging electric devices electrically connected to the pads 405 and 407.

Note the voltage regulator 400 is merely one example showing schematic implementations of some embodiments of the invention, and by no means limits the scope of the invention. Other equivalent circuit deigns may be implemented without deviating from the spirit of the invention. For example, the switch can be implemented by NMOS devices, bipolar devices, relays . . . etc., used in conjunction with logic devices, such as inverters, AND, NAND, OR, NOR gates . . . etc. Likewise, the over-current protection device is by no means limited to a PNP bipolar device coupled with a resistor as illustrated in FIG. 4. Other devices, such as NPN bipolar devices, diodes, MOS transistors . . . etc., can be used to provide the proposed voltage regulator with over-current protection capability. By the same token, other equivalent devices instead of Zener Schottky diodes can be used as an offset device without deviating from the spirit of the invention.

Figure 5:
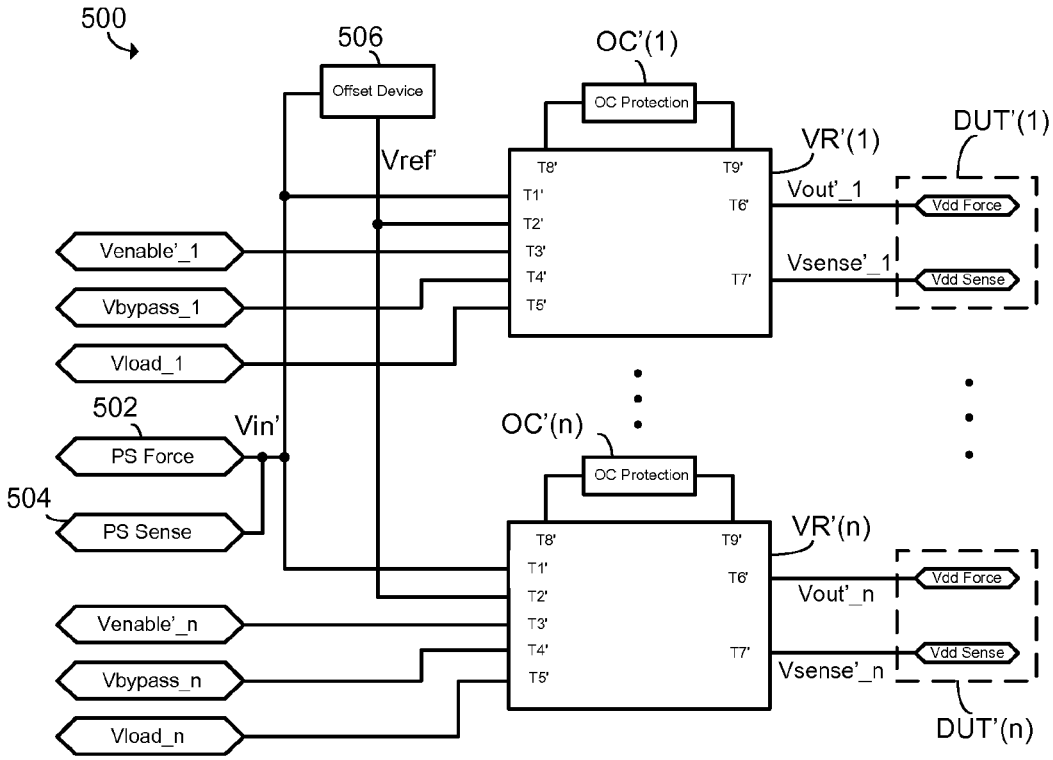
FIG. 5 illustrates a block diagram showing a voltage regulator array in accordance with some embodiments of the invention.

FIG. 5 illustrates a block diagram showing a voltage regulator array 500 in accordance with some embodiments of the invention. The voltage regulator array 500 can be implemented in many applications, such as a probe card assembly used in conjunction with a prober and a tester for testing a plurality of DUTs. Although the voltage regulator array 500 is described and explained in the context of probe card assemblies in this disclosure, it can also be used in apparatuses or systems other than probe card assemblies without deviating from the spirit of the invention.

The voltage regulator array 500 can include a number of voltage regulators VR'(1), . . . VR'(n) coupled between one or more power supplies (not shown in the figure) and their corresponding DUTs (DUT'(1), . . . DUT'(n)). Each of the voltage regulators VR'(1), . . . VR'(n) can include a plurality of terminals T1', T2' . . . T9'. Terminal T1' can be coupled to the one or more power supplies at pads, such as 502 and 504. Terminal T2' can be coupled to an offset device 506, which can be further coupled to the one or more power supplies at pads, such as 502 and 504. The one or more power supplies (not shown) can be implemented in an electronic apparatus, such as a tester connected to a probe card assembly, examples of which will be described in greater details in following paragraphs with reference to FIGS. 7 and 8. Terminal T3' can be coupled to an enable signal Venable'_1, . . . or Venable'_n adapted to enable its corresponding voltage regulator VR'(1), . . . or VR'(n). Terminal T4' can be coupled to a bypass mode bias Vbypass_1, . . . or Vbypass_n adapted to initiate a bypass mode of its corresponding voltage regulator VR'(1), . . . or VR'(n). Terminal T5' can be coupled to a current load control signal Vload_1, . . . or Vload_n adapted to provide its corresponding voltage regulator VR'(1), . . . or VR'(n) with a desired current load. Terminal T6' can be coupled to DUT'(1), . . . or DUT'(n) for providing the same with its corresponding power output Vout'_1, . . . or Vout'_n. Terminal T7' can be coupled to DUT'(1), . . . or DUT'(n) for receiving there form a corresponding sense signal Vsense'_1, . . . or Vsense'_n indicating a voltage level of the corresponding power output Vout'_1, . . . or Vout'_n. Terminals T8' and T9' can be coupled to their corresponding over-current protection device OC'(1), . . . or OC'(n), which protects its corresponding power supply from an over-current exceeding a predetermined over-current value.

Note that although only two voltage regulators VR'(1) and VR'(n) are depicted in this figure, the number of voltage regulators is by no means limited to two and can be more or less than two. Also note that although only one offset device 506 is depicted in the figure, the number of offset devices is by no means limited to one and can be more than one. For example, the number of offset devices can be the same as that of voltage regulators, and each offset device can be coupled to its corresponding voltage regulator. As another example, each one offset device can be coupled to a group of voltage regulators, and the number of voltage regulators each offset device is coupled to can be different. For example, one offset device can be configured to couple with three voltage regulators, whereas another offset device can be configured to couple with four voltage regulators.

In operation, one or more of the voltage regulators VR'(1), . . . and VR'(n) can be selectively enabled by asserting one or more of the enable signals Venable'_1, . . . and Venable'_n. The enabled voltage regulator VR'(1), . . . or VR'(n) can receive a power input Vin' at terminal T1' and a reference signal Vref' at terminal T2', whose voltage level can be determined by subtracting the voltage level of the power input Vin' with a predetermined offset value. The enabled voltage regulator VR'(1), . . . or VR'(n) can generate the power output Vout'_1, . . . or Vout'_n, and receive a sense signal Vsense'_1, . . . or Vsense'_n indicating a voltage level of its corresponding power output Vout'_1, . . . or Vout'_n. The enabled voltage regulator VR'(1), . . . or VR'(n) can compare the reference signal Vref' with the received sense signal Vsense'_1, . . . or Vsense'_n to adjust the voltage level of the power output Vout'_1, . . . or Vout'_n until the voltage level of the power output Vout'_1, . . . or Vout'_n becomes equal a value proportional to that of the reference signal Vref'.

Given a constant offset value, adjusting the voltage level of the power input Vin' can change the voltage level of the reference signal Vref', and therefore the voltage level of the power output Vout'_1, . . . or Vout'_n. In the context where the voltage regulator array 500 is implemented in a probe card assembly coupled to a tester for testing DUTs (such as a system generally described in FIG. 1A), the power outputs Vout'_1, . . . and Vout'_n for their corresponding DUTs (DUT'(1), . . . and DUT'(n)) can be adjusted simply by altering the voltage level of the power input Vin' generated by a power supply in the tester. This can eliminate the need of programming voltage regulators individually and independently in order to provide the DUTs with power outputs at a desired voltage level. The proposed voltage regulators, for example as the ones illustrated in FIG. 5, can simplify the design and operation of probe card assemblies, and shorten the time required to ready the probe card assemblies for testing. As a result, the costs of making the probe card assemblies can be reduced, and the tested per unit time of each DUT can be reduced as well.

Note that the voltage regulator VR'(1), . . . VR'(n) can be understood as being able to carry out, among other things, the functions of the controller 206 and the variable switch 202 shown in FIG. 2 in the sense that the controller 206 can generate a control signal based on a voltage difference between the reference signal Vref and the sense signal Vsense to control the variable switch 202. In some embodiments of the invention, the offset device 506 can be implemented internally in each voltage regulator VR'(1), . . . or VR'(n) as shown in FIG. 2, instead of a separate element as shown in FIG. 5.

Note that the enable signals Venable'_1, . . . and Venable'_n can be optional. In some embodiments of the invention, the enable signals Venable'_1, . . . and Venable'_n can be omitted. In some embodiments of the invention, one enable signal can control more than one voltage regulators VR'(1), . . . and VR'(n), simultaneously. Note that the numbers of voltage regulators controlled by different enable signals can be different. For example, one enable signal can be configured to control two voltage regulators simultaneously, whereas another enable signal can be configured to control three voltage regulators simultaneously.

One or more of the bypass mode biases Vbypass_1, . . . and Vbypass_n can be asserted for their corresponding one or more of the voltage regulators VR'(1), . . . and VR'(n) to enter into a bypass mode. In a bypass mode, pad 401/403 coupled to the power input Vin can be directly connected to pad 407/405 coupled to the power output Vout, the voltage regulator functions can be disabled, and other functions such as enabling (On/Off) may still be used. The bypass mode can allow for measurements of low DUT currents. Apparatuses, such as testers, coupled to pads 502 and/or 504 can therefore measure and analyze the signals in the DUTs (DUT'(1), . . . and DUT'(n)). Such bypass mode is advantageous because it enables direct measurement and analysis of currents in the DUTs (DUT'(1), . . . and DUT'(n)).

Note that the bypass mode biases Vbypass_1, . . . and Vbypass_n can be optional. In some embodiments of the invention, one bypass mode bias can be configured to control two or more voltage regulators. Note that the numbers of voltage regulators controlled by different bypass mode biases can be different. For example, one bypass mode bias can be configured to control two voltage regulators simultaneously, whereas another bypass mode bias can be configured to control three voltage regulators simultaneously.

During an over-current event where the current of the power input Vin' exceeds a predetermined over-current value, the over-current protection devices OC'(1), . . . and OC'(2) can prevent the voltage regulators VR'(1), . . . and VR'(n) from passing through the over-current that may damage the DUTs (DUT'(1), . . . and DUT'(n)). In some embodiments of the invention, the over-current protection device OC'(1), . . . and OC'(n) can be current clamp devices that limit the current passing through the voltage regulators VR'(1), . . . and VR'(n) in a predetermined allowable range. In some embodiments of the invention, the over-current protection devices OC'(1), . . . and OC'(n) can be current trip devices that prevent an current from passing through the voltage regulators VR'(1), . . . and VR'(n), when the current exceeds a predetermined over-current value.

The over-current protection devices can be implemented in various manners. For example, the over-current protection devices can be implemented by electronic devices, such as PMOS devices, NMOS devices, PNP bipolar devices, NPN bipolar devices, logic gates, resistors, and a combination thereof. The over-current devices can be fabricated in a form of conventional or integrated circuit.

Note that the over-current protection devices OC'(1), . . . and OC'(n) can be optional. In some embodiments of the invention, one over-protection device can be configured to control two or more voltage regulators. Note that the numbers of voltage regulators controlled by different over-current protection devices can be different. For example, one over-current protection device can be configured to control two voltage regulators simultaneously, whereas another over-current protection device can be configured to control three voltage regulators simultaneously.

The current load control signals Vload_1, . . . and Vload_n can be asserted to ensure their corresponding voltage regulators VR'(1), . . . and VR'(n) to generate power outputs Vout'_1, . . . and Vout'_n with an sufficient amount of current, thereby improving the stability of voltage regulation by supplying an output load when one does not exist. Such current load control scheme can be implemented, for example, by coupling a switch with a resistor, or any other combinations of electronic devices. Examples of such current load control scheme will be discussed in greater detail in following paragraphs.

Note that the current load control signals Vload_1, . . . and Vload_n can be optional. In some embodiments of the invention, one current load control signal can be configured to control two or more voltage regulators. Note that the numbers of voltage regulators controlled by different current load control signal can be different. For example, one current load control signal can be configured to control two voltage regulators simultaneously, whereas another current load control signal can be configured to control three voltage regulators simultaneously.

Figure 6:
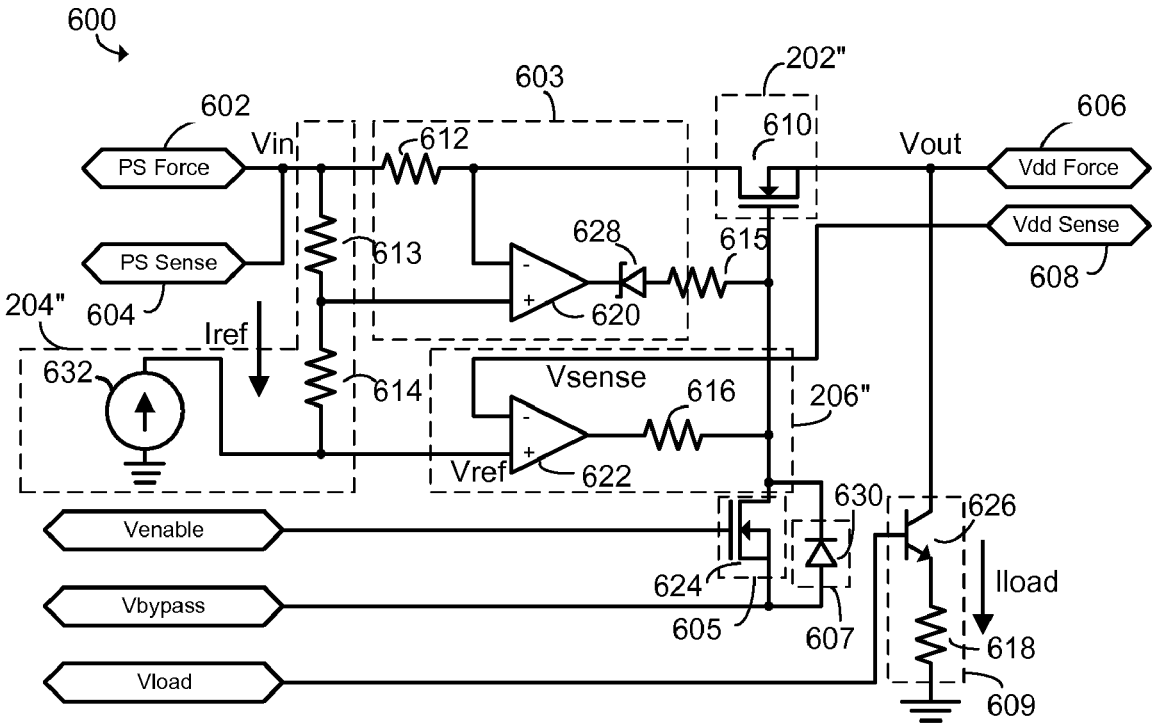
FIG. 6 schematically illustrates a proposed voltage regulator in accordance with some embodiments of the invention.

FIG. 6 schematically illustrates one exemplary voltage regulator 600 in accordance with some embodiments of the invention. The voltage regulator 600 can include a variable switch 202", a controller 206", and an offset device 204" configured in a manner similar to those in FIG. 2. The voltage regulator 600 can include an optional over-current protection device 603, enable module 605, bypass module 607, and current load module 609. The over-current protection device 603 can protect the voltage regulator 600 against an over-current exceeding a predetermined value. The enable module 605 can allow the voltage regulator 600 to be turned on or off in response to an enable signal. The bypass module 607 can bypass the controller 206" to turn on the variable switch 202", such that currents in the DUT coupled to pads 606 and 608 can be observed directly at pads 602 and 604. The current load module 609 can ensure the power output Vout of the variable switch 202" with sufficient current. It is understood by people skill in the art of circuit design that the variable switch 202", the controller 206", the offset device 204", and the over-current protection device 603, the enable module 605, the bypass module 607, and the current load module 609 can be implemented in a myriad of ways. The schematic implementation illustrated in FIG. 6 is merely an example of one possible embodiment of the invention.

A voltage regulator 600 can be coupled between a power supply (not shown in the figure) at pads (or connection points) 602, 604 and an electronic device, such as a DUT, at pads 606, 608. The voltage regulator 600 can include an NMOS devices 610 and 624, resistors 612, 613, 614, 616 and 618, operational amplifiers 620 and 622, an NPN bipolar device 626, and diodes 628 and 630.

The operational amplifier 620 can have a first input node coupled between the resistor 612 and a drain of the NMOS device 610, a second input node coupled between the resistors 613 and 614, and an output node coupled to a Zener Schottky diode 628. The operational amplifier 622 can have a first input node coupled to pad 608, a second input node coupled to a reference current source 632, and an output node coupled to the resistor 616, which is further coupled to a gate of the NMOS transistor 610. The NMOS transistor 624 can have a source coupled to the gate of the NMOS transistor 610, a drain coupled to a bypass mode bias Vbypass, and a gate coupled to an enable signal Venable. The diode 630 can be coupled to the NMOS device 624 in parallel. In some embodiments of the invention, the diode 630 can be parasitic to the NMOS device 624. The NPN bipolar device 626 can have a collector coupled to the source of the NMOS device 610, an emitter coupled to the resistor 618, and a base coupled to a current load control signal Vload.

The NMOS device 610 and the operational amplifier 622 can function as the variable switch 202 and the controller 206 as shown in FIG.2, respectively. The resistors 613 and 614 coupled with the reference current source 632 can function as the offset device 204 shown in FIG. 2. The resistors 612 and 613, the operational amplifier 620, and the Zener Schottky diode 628 can function as an over-current protection device as those shown in FIGS. 3 and 5. The NMOS device 624 can function as an enable module controlled by an enable signal Venable to turn on and off the voltage regulator 600. The diode 630 can function as a bypass module enabling the voltage regulator 600 to enter a bypass mode in response to a bypass mode bias Vbypass. The NPN bipolar device 626 coupled with the resistor 618 can function as a current load module that ensures sufficient current to be provided at pad 606.

The voltage regulator 600 can be enabled or disabled by controlling the voltage levels of the enable signal Venable and the bypass mode bias Vbypass. When the voltage regulator 600 is enabled, the enable signal Venable can go low to turn off the NMOS device 624 and the bypass mode bias Vbypass can go low to prevent from affecting the operation of the NMOS transistor 610. When the voltage regulator 600 is disabled, the enable signal Venable can go high to turn on the NMOS device 624 and the bypass mode bias Vbypass can be connected to ground to turn off the NMOS transistor 610.

In operation, a power supply provides a power input Vin at pad 602. The reference current source 632 ensures a reference current Iref flowing through the resistors 613 and 614 to be constant, such that a reference signal Vref at one input terminal of the operational amplifier 622 can have a voltage level equal to that of the power input Vin minus a predetermined offset value defined as the constant reference current Iref times the combined resistance of the resistors 613 and 614. The operational amplifier 622 can receive a sense signal Vsense indicating the voltage level of a power output Vout at the source of the NMOS device 610. The operational amplifier can compare voltage levels of the sense signal Vsense and the voltage level of the reference signal Vref to generate a control signal controlling the extent to which the NMOS transistor 610 is turned on or off until the voltage level of the power output Vout becomes equal to that of the reference signal Vref. When the current load control signal Vload is asserted to turn on the NPN bipolar device 626, the resistor 618 can ensure the power output Vout to have sufficient current.

In an over-current protection mode where an current flowing from pad 602 to pad 606 through the NMOS device 610 exceeds a predetermined over-current value, the operational amplifier 620 can generate a control signal to turn off the NMOS device 610 to an extent accordingly since the voltage drop across the resistor 612 is much larger than the voltage drop across the resistor 613. As a result, the amount of current allowed to pass through the NMOS transistor 610 can be limited in a desired range.

In a bypass mode, the bypass mode bias Vbypass can be asserted to turn on the NMOS device 610 by forcing its way through the diode 630, such that pad 602/604 coupled to the power input Vin can be directly connected to pad 606/608 coupled to the power output Vout. The bypass mode can allow for measurements of low DUT currents. A resistor 615 can be implemented between the anode of the diode 628 and the gate of the NMOS device 610 to prevent the operational amplifier 620 from being damaged by the bypass mode bias Vbypass that passes through the diode 630.

Note that FIG. 6 merely illustrates an example of the circuit implementation of the invention. The polarity of the devices in FIG. 6 can be altered where, with proper modifications appreciated by people skilled in the art in light of the disclosure, NMOS devices can be replaced with PMOS devices, and NPN bipolar devices can be replaced with PNP bipolar devices. Other electronic devices, such as capacitors, inverters, AND, NAND, OR, NOR, relays . . . etc. can be used in equivalent alternatives to achieve the intended functions without deviating from the spirit of the invention. For example, the diode 630 can be substituted with a switch that can be configured to selectively passing the bypass mode bias Vbypass to control the variable switch 202". Other equivalent circuitries as the one shown in FIG. 2 can be obtained without undue experiment in light of this invention disclosure.

Figure 7:
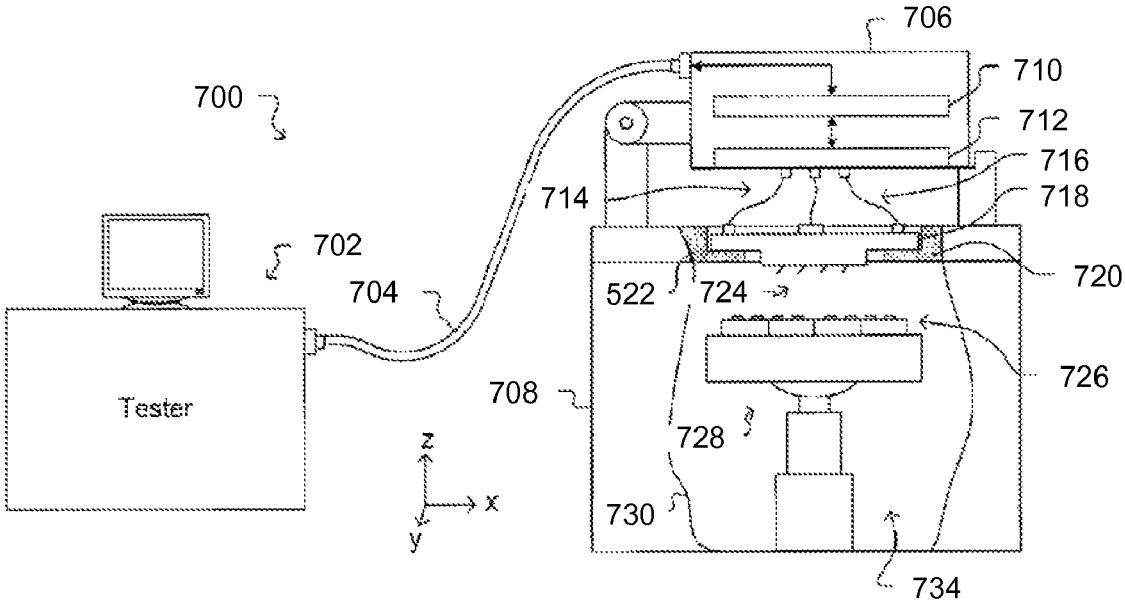
FIG. 7 illustrates a diagram showing a test system including a probe card assembly, in which a number of the proposed voltage regulators can be implemented, in accordance with some embodiments of the invention.

FIG. 7 illustrates an exemplary test system 700, in which the proposed voltage regulator can be employed, according to some embodiments of the invention. As shown in FIG. 7, the test system 700 can include a tester 702. Test system 700 can also include a probe card assembly 718 comprising probes 724 disposed to contact DUTs 726. Communications channels can be provided between the tester 702 and the probe card assembly 718 by communications connection 704, test head 706, and electrical connections 716. That is, communications connection 704 (e.g., coaxial cables, fiber optics, wireless transmitters/receivers) can provide electrical signal paths between the tester 702 and the test head 706, which can include driver/receiver circuits 710 and an interface board 712. The driver/receiver circuits 710 can be configured to receive signals sent by the tester 702 through the communications connection 704 to the test head 706, and the driver/receiver circuits 710 can also be configured to drive signals from the test head 706 through the communications connection 704 to the tester 702. The driver/receiver circuits 710 can be electrically connected through the interface board 712 to electrical connection 716, which can electrically connect the test head 706 to the probe card assembly 718.

As shown in FIG. 7, the probe card assembly 718 can be attached to and detached from a head plate 720 of a prober 734, which can comprise a housing or enclosure in which can be disposed, among other things, a movable chuck 728 on which DUTs 726 can be disposed. Chuck 728 can thus constitute a holder for holding DUTs 726 during testing of the DUTs. (FIG. 7 includes cut away 730, which provides a partial view into an interior of the prober 734.)

Once the probe card assembly 718 is attached to the head plate 720 (which can comprise a top portion of the prober 734) and electrically connected through electrical connections 716 to the test head 706 (e.g., to circuitry on the interface board 712), chuck 728 can move DUTs 726 into contact with probes 724 of the probe card assembly 718 and thereby establishing temporary electrical connections between the probes 724 and the DUTs 726. The chuck 728 can be capable of moving in the "x," "y," and/or "z" directions and can be further capable of rotating and tilting. While the probes 724 are in contact with the DUTs 726, the tester 702 can provide test signals, power, and ground to the DUTs 726, and the tester 702 can analyze response signal generated by the DUTs 726 in response to the test signals.

As mentioned, the probe card assembly 718 can be attached to and detached from the head plate 720 of the prober 734. For example, the probe card assembly 718 can be bolted, clamped, etc. to the head plate 720, and thereafter the probe card assembly 718 can be unbolted, unclamped, etc. The probe card assembly 718 can also be electrically connected to and electrically disconnected from the electrical connections 716. Thus, a probe card assembly 718 can be attached to the head plate 720, electrically connected to electrical connections 716, and then used to test one or more DUTs 726. Thereafter, the probe card assembly 718 can be detached from the head plate 720, disconnected from the electrical connections 716, and removed. A different probe card assembly (not shown) can then be attached to the head plate 720 and electrically connected to the electrical connections 716 and then used to test other DUTs. The tester 702 and test head 706 (including any electronics in the test head 706, such as the driver/receiver circuits 710 and the interface board 712) can thus remain in place and be used with different probe card assemblies (e.g., like 718). Examples of such test system 700 can be found and described in greater detail in, for example, U.S. Patent Application Publication No. 2008/0054917.

Figure 8:
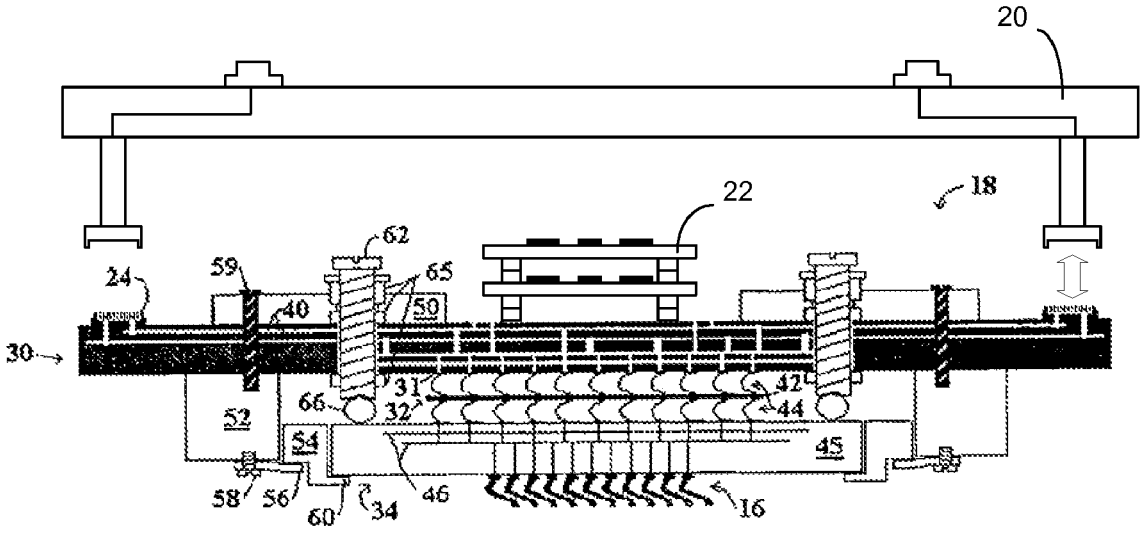
FIG. 8 illustrates a cross-sectional view of a probe card assembly, in which a number of the proposed voltage regulators can be implemented, in accordance with some embodiments of the invention.

FIG. 8 shows a cross sectional view of an exemplary probe card assembly 18, in which the proposed self-regulating voltage regulator can be employed, in accordance with some embodiments of the invention. The probe card assembly 18 can be configured to provide both electrical pathways and mechanical support for the probes 16 that will directly contact the wafer. The probe card assembly 18 can be connected directly to a tester (not shown in the figure) via one or more connectors 24, or at least one tester connection board 20 coupled between the connecter 24 and the tester. The probe card electrical pathways can be provided through a printed circuit board (PCB) 30, an interposer 32, and a space transformer 34. Channel transmission lines 40 can distribute signals from the tester via the connectors 24 horizontally in the PCB 30 to contact pads on the PCB 30 to match the routing pitch of pads on the space transformer 34. The interposer 32 can include a substrate 42 with spring probe electrical contacts 44 disposed on both sides. The interposer 32 can electrically connect individual pads 31 on the PCB 30 to pads forming a land grid array (LGA) on the space transformer 34. Traces 46 in a substrate 45 of the space transformer 34 can distribute or transform pitches of connections from the LGA to spring probes 16 configured in an array. The space transformer substrate 45 can be constructed from either multilayered ceramic or organic based laminates. The space transformer substrate 45 with embedded circuitry, probes and LGA can be referred to as a probe head.

Mechanical support for the electrical components can be provided by a back plate 50, bracket (Probe Head Bracket) 52, frame (Probe Head Stiffener Frame) 54, leaf springs 56, and leveling pins 62. The back plate 50 can be provided on one side of the PCB 30, while the bracket 52 can be provided on the other side and attached by screws 59. The leaf springs 56 can be attached by screws 58 to the bracket 52. The leaf springs 56 can extend to movably hold the frame 54 within the interior walls of the bracket 52. The frame 54 then includes horizontal extensions 60 for supporting the space transformer 34 within its interior walls. The frame 54 can surround the probe head and maintain a close tolerance to the bracket 52 such that lateral motion can be limited.

Leveling pins 62 complete the mechanical support for the electrical elements and provide for leveling of the space transformer 34. The leveling pins 62 can be adjusted so that brass spheres 66 provide a point contact with the space transformer 34. The spheres 66 contact outside the periphery of the LGA of the space transformer 34 to maintain isolation from electrical components. Leveling of the substrate can be accomplished by precise adjustment of these spheres through the use of advancing screws, or leveling pins 62. The leveling pins 62 can be screwed through supports 65 in the back plate 50 and PCB 30. Motion of the leveling pin screws 62 can be opposed by leaf springs 56 so that spheres 66 are kept in contact with the space transformer 34. Examples of such probe card assembly 18 can be found and described in greater detail in, for example, U.S. Patent Application Publication No. 2007/0261009.

As discussed above, the proposed self-referencing voltage regulator can be implemented in a probe card assembly used in a test system where a plurality of DUTs on a semiconductor wafer can be tested. In some embodiments of the invention, the self-referencing voltage regulator can be implemented in the PCB 30, the interposer 32, or the tester connection board 20. In some other embodiments of the invention, one or more extension cards 22, which may be implemented with data processing capability, can be connected to the PCB 30. The self-referencing voltage regulator can also be implemented in the extension cards 22. In some other embodiments of the invention, the self-referencing voltage regulator can be implemented in the tester 702 as shown in FIG. 7.

In some embodiments of the invention, each self-referencing voltage regulator can be connected to each DUT to provide it with power outputs at a desired voltage level, which can be adjusted simply by changing the voltage level of the power inputs from a tester in the test system. The proposed self-referencing voltage regulator can eliminate the need of programming and reprogramming the probe card assembly in order to obtain a desired voltage level of the power output. As a result, the time required for setting up the test system can be significantly shortened compared to conventional designs where the voltage regulators need to be adjust individually and independently. This, in turn, improves the yield of DUTs. Moreover, the proposed self-referencing voltage regulator allows the probe card assembly and the tester to be designed in a simple manner. No complicated circuits are needed for the probe card assembly or the tester in order to adjust the voltage level of the power outputs of voltage regulators. In addition, the proposed self-referencing voltage regulator can be provided with an over-current protection scheme, such that sensitive electronic devices in or connected to the probe card assemblies can be protected from potential damages caused during an over-current event.

Although specific embodiments and applications of the invention have been described in this specification, there is no intention that the invention be limited these exemplary embodiments and applications or to the manner in which the exemplary embodiments and applications operate or are described herein. For example, particular exemplary test systems have been disclosed, but it will be apparent that the inventive concepts described above can apply equally to alternate arrangements of a test system. Moreover, while specific exemplary processes for testing an electronic device have been disclosed, variations in the order of the processing steps, substitution of alternate processing steps, elimination of some processing steps, or combinations of multiple processing steps that do not depart from the inventive concepts are contemplated. Accordingly, it is not intended that the invention be limited except as by the claims set forth below.

We claim:

1. A probe card assembly for testing an electronic device, comprising:

a substrate having a plurality of probes extending there from for forming electrical contacts with the electronic device;

one or more pathways adapted to electrically connect ones of the probes to a tester; and a voltage regulator having an input terminal for receiving a power input having a first voltage level, and an output terminal connected to a power one of the probes, wherein the voltage regulator is configured to provide from the power input at the first voltage level a regulated power output at a third voltage level to the power one of the probes, wherein the third voltage level is proportional to a reference signal having a second voltage level derived from the first voltage level adjusted with a predetermined offset value.

2. The probe card assembly of claim 1 wherein the voltage regulator comprises an offset device for subtracting the predetermined offset value from the first voltage level to obtain the second voltage level at which the reference signal is generated.

3. The probe card assembly of claim 2 wherein the voltage regulator comprises a controller for generating a control signal based on a comparison between the reference signal and a sense signal indicating a voltage level of the power output for controlling the power output at the third voltage level.

4. The probe card assembly of claim 3 wherein the controller comprises an operational amplifier having a first input node receiving the reference signal, a second input node receiving the sense signal, and an output node generating the control signal.

5. The probe card assembly of claim 4 wherein the voltage regulator comprises a variable switch for generating the power output in response to the power input and the control signal.

6. The probe card assembly of claim 5 wherein the third voltage level of the power output changes as the first voltage level of the power input changes.

7. The probe card assembly of claim 5 wherein the voltage regulator comprises an over-current protection device for preventing a current passing through the variable switch from exceeding a predetermined over-current value.

8. The probe card assembly of claim 5 wherein the voltage regulator comprises a bias module for turning on the variable switch regardless of the control signal in response to a bypass mode bias.

9. The probe card assembly of claim 5 wherein the voltage regulator comprises an enable module for selectively turning on or off the variable switch in response to an enable signal.

10. The probe card assembly of claim 5 wherein the voltage regulator comprises a current load module for providing the power output with a predetermined amount of current in response to a current load control signal.

11. The probe card assembly of claim 1 wherein the electrical pathways comprise a printed circuit board, an interposer, an extension card, a tester connection board.

12. A method for testing an electronic device, comprising:

forming one or more electrical contacts between a probe card assembly and the electronic device; and supplying a voltage regulator of the probe card assembly with a power input at a first voltage level;

adjusting a power output of the voltage regulator comprising:

generating the power output in response to the power input at the first voltage level and a reference signal at a second voltage level derived from the first voltage level adjusted with a predetermined offset value; and adjusting the first voltage level of the power input to change the second voltage level of the reference signal, wherein a third voltage level at which the power output is generated follows the second voltage level.

13. The method of claim 12 further comprising subtracting the predetermined offset value from the first voltage level to obtain the second voltage level at which the reference signal is generated.

14. The method of claim 12 further comprising generating a control signal base on a comparison between the reference signal and a sense signal indicating a voltage level of the power output for controlling a variable switch in the voltage regulator that generates the power output.

15. The method of claim 14 further comprising preventing a current passing through the variable switch from exceeding a predetermined over-current value.

16. The method of claim 15 wherein the preventing comprises blocking the current exceeding the predetermined over-current value from passing through the variable switch.

17. The method of claim 14 wherein the preventing comprises limiting a current passing through the variable device in a predetermined range.

18. The method of claim 14 further comprising asserting a bypass mode bias to turn on the variable switch regardless of the control signal.

19. The method of claim 14 further comprising asserting an enable single to turn on the variable switch for allowing the control signal to control the variable switch.

20. The method of claim 14 further comprising asserting a current load control signal to provide the power output with a predetermined amount of current.

* * * * *